US011946201B2

(12) United States Patent
Yao et al.

(10) Patent No.: US 11,946,201 B2
(45) Date of Patent: Apr. 2, 2024

(54) MULTILAYER STRAND STEEL WIRE ROPE PRODUCTION DEVICES

(71) Applicant: Jiangsu Xingda Steel Tyre Cord Co., Ltd., Jiangsu (CN)

(72) Inventors: Lili Yao, Jiangsu (CN); Jinlan Liu, Jiangsu (CN); Shoupeng Kou, Jiangsu (CN); Chenlu Zhu, Jiangsu (CN); Xianghui Liu, Jiangsu (CN); Changxin Chen, Jiangsu (CN); Qingsheng Tian, Jiangsu (CN)

(73) Assignee: Jiangsu Xingda Steel Tyre Cord Co., Ltd. (CN)

( * ) Notice: Subject to any disclaimer, the term of this patent is extended or adjusted under 35 U.S.C. 154(b) by 0 days.

(21) Appl. No.: 17/284,682

(22) PCT Filed: Mar. 2, 2020

(86) PCT No.: PCT/CN2020/077414

§ 371 (c)(1),
(2) Date: Apr. 12, 2021

(87) PCT Pub. No.: WO2021/164051

PCT Pub. Date: Aug. 26, 2021

(65) Prior Publication Data

US 2023/0017733 A1 Jan. 19, 2023

(30) Foreign Application Priority Data

Feb. 20, 2020 (CN) ..... 202010104096.1

(51) Int. Cl.

| | |
|---|---|
| ***D07B 7/02*** | (2006.01) |
| ***D07B 1/06*** | (2006.01) |
| ***D07B 3/04*** | (2006.01) |

(52) U.S. Cl.

CPC ..... *D07B 7/025* (2013.01); *D07B 1/068* (2013.01); *D07B 3/04* (2013.01); *D07B 2201/2021* (2013.01); *D07B 2207/209* (2013.01)

(58) Field of Classification Search

CPC . D07B 7/025; D07B 7/02; D07B 7/00; D07B 7/14; D07B 1/068; D07B 1/06;

(Continued)

(56) References Cited

U.S. PATENT DOCUMENTS 2,319,827 A * 5/1943 Reardon ..... D07B 7/06 57/65
2,445,365 A * 7/1948 Reardon ..... D07B 3/06 57/218

(Continued)

*Primary Examiner* — Khoa D Huynh
*Assistant Examiner* — Uyen T Nguyen

(57) ABSTRACT

A multilayer strand steel wire rope production device is provided. A pre-former is fixed on a drum, and a specific position of the pre-former is defined, a center strand payoff spool and a plurality of outer winding strand payoff spools are provided in the drum. The first wire guide mechanism is close to the corresponding outer winding strand payoff spool. One end of the outer surface of the drum away from the first wire guide mechanism is provided with a second wire guide mechanism, and a hub is additionally provided and located on one side of the drum close to the second wire guide mechanism; outer winding strands drawn from the plurality of outer winding strand payoff spools sequentially pass the first wire guide mechanism, the pre-former, and the second wire guide mechanism, and are guided to the hub for gathering to complete strand wire twisting.

8 Claims, 3 Drawing Sheets

(58) Field of Classification Search
CPC ..... D07B 1/0646; D07B 3/04; D07B 3/00; D07B 3/02; D07B 2201/2021
See application file for complete search history.

(56) References Cited

U.S. PATENT DOCUMENTS

| | | | | | |
|---|---|---|---|---|---|
| 2,476,180 | A * | 7/1949 | Charles | D07B 1/068 | 57/311 |
| 2,525,230 | A * | 10/1950 | Maccreadie | D07B 3/00 | 57/58.57 |
| 3,240,570 | A * | 3/1966 | Grimes, Jr. | D07B 3/04 | 174/128.1 |
| 3,672,142 | A * | 6/1972 | Gilmore | D07B 7/14 | 57/17 |
| 3,934,395 | A * | 1/1976 | Vryland | G02B 6/449 | 57/13 |
| 4,073,127 | A * | 2/1978 | Orlandi | D07B 3/00 | 57/115 |
| 4,182,106 | A * | 1/1980 | Henry | A61C 7/20 | 57/212 |
| 4,195,469 | A * | 4/1980 | Tarantola | D07B 5/12 | 57/58.3 |
| 4,356,846 | A * | 11/1982 | Yamada | D07B 1/0693 | 140/147 |
| 4,530,205 | A * | 7/1985 | Seiler | D07B 1/08 | 57/311 |
| 4,802,328 | A * | 2/1989 | Senyagin | D07B 7/025 | 57/314 |
| 2021/0180219 | A1 * | 6/2021 | Cornille | D02G 3/28 | |

* cited by examiner

MULTILAYER STRAND STEEL WIRE ROPE PRODUCTION DEVICES

FIELD

The present invention relates to the technical field of steel wire rope processing production, and in particular, to a multilayer strand steel wire rope production device.

BACKGROUND

Devices for producing steel wire ropes mainly include a basket-type stranding machine, a large bearing-type tubular machine, and a tubular-type machine. The basket-type stranding machine mainly produces steel wire ropes having a thick specification, for example, 10 mm or more greater than the diameter of the steel wire rope; the tubular-type machine is mainly used for producing steel wire ropes having a finer specification, for example, 1.5 mm to 10 mm; a large bearing-type stranding machine is an updated version of the tubular-type machine, is changed into a large bearing-type from an early support wheel-type, and has a higher twisting speed. When multilayer strand steel wire ropes are subjected to laying-up on the tubular-type machine, outer winding strands are pre-deformed by means of pre-deformation, the pre-deformation treatment enables the steel wire ropes to have better tightness, so as to ensure that the steel wire ropes do not have loose ends.

In the prior art, strand wire payoff bases are fixed inside the drum during the production of the steel wire ropes, and do not rotate along with the drum; a plurality of outer winding strand steel wires respectively led out from a plurality of strand wire payoff bases is guided along the outer wall of the drum to a twisting point for twisting, and positions close to the twisting point are selected as mounting positions of the pre-former, not only mounting is easy, but the production of the steel wire ropes is also facilitated. Such a configuration mode can satisfy the production requirements for simple structures such as 7*7 and 7*3 of steel wire ropes during regular production, but is hardly applicable when producing the multilayer strand steel wire ropes having a complex strand wire structure, for example, a specification of 6*19-wsc alternating twisting structural steel wire ropes.

For the multilayer strand steel wire rope, a plurality of steel wires are twisted around the central steel wire into outer winding strands; the outer winding strands may be steel wire strands having the same specification, and may also be steel wire strands having multiple different specifications according to actual needs; and then a plurality of the outer winding strands are twisted around a center strand into the multilayer strand steel wire rope. The center strand may be a steel wire strand having the same specification as that of the outer winding strand, and may also be a steel wire strand having other specifications according to actual needs. The operating principle of existing tubular-type stranding devices is that: a plurality of steel wires drawn by a payoff spool are guided by a general wire guide mechanism, are required to be pre-deformed by means of a pre-former, and then are twisted at the hub; the position of the pre-former is very close to the hub (i.e., the twisting point). However, the applicant finds out that when the existing tubular-type stranding devices are used for producing the multilayer strand steel wire ropes, the problems of outward protrusion, core exposure, and blistering occur very easily, that is, the central steel wire of the outer winding strand protrudes outwardly and is exposed, so that the performance of the multilayer strand steel wire rope is severely influenced, causing the whole roll of the multilayer strand steel wire rope to be scrapped; if the pre-former is not used in the prior art, although twisting the outer winding strands on the center strand avoids outward protrusion and exposing of the central steel wire of the outer winding strand, but a serious loose end problem easily occurs. The outward protrusion phenomenon of the central steel wire occurs after an outer winding strand wire passes the pre-former, and the reasons are, on one hand, a subtle difference in models such as the diameters of strand wires, and on the other hand, that the pre-former would cause the outer winding strand to be bent in a wavy manner, so that gaps are generated between outer winding steel wires, thereby providing the probability of outward protrusion of the central steel wire of the outer winding strand. For example, when performing laying-up production in an initial operation, no abnormality is found in the obtained multilayer strand steel wire ropes; however, when continuing to operate by changing to next batch of strand wires when a payoff unit reaches a fixed length, there is a probability of occurrence of the outward protrusion phenomenon of the central steel wire of the outer winding strand, and if it is not found in time, waste products would be generated. For another example, when 7*19–φ3.0 mm and 7*19–φ3.2 mm of galvanized steel wire ropes having the same structure are produced, the diameter specifications of the two steel wire ropes are similar, but the twisting pitches of outer winding strands constituting the steel wire ropes are different. The two are subjected to laying-up in an existing tubular-type machine, no abnormality is found in producing 7*19–φ3.0 mm, and the abnormal phenomenon of outward protrusion of the outer winding strand occurs when changing to laying-up of 7*19–φ3.2 mm of strand wires after the production ends. At present, no one has done further research on this problem at home and abroad.

SUMMARY

In view of the disadvantages of the prior art, the present invention provides a multilayer strand steel wire rope production device. A pre-former is fixedly provided on the outer surface of a drum, and outer winding strands are released from an outer winding strand payoff spool and then are pre-deformed in advance, so that the occurrence of problems of outward protrusion, core exposure, and blistering of central steel wires of the outer winding strands is significantly reduced, the quality of the multilayer strand steel wire rope is ensured, and waste is greatly reduced. Specifically, implementation is achieved by means of the following technologies.

A multilayer strand steel wire rope production device, including a drum, where a center strand payoff spool and a plurality of outer winding strand payoff spools are provided in the drum, pre-formers corresponding to the outer winding strand payoff spools and a first wire guide mechanism are provided on the outer surface of the drum, and the first wire guide mechanism is close to the corresponding outer winding strand payoff spool; one end of the outer surface of the drum away from the first wire guide mechanism is provided with a second wire guide mechanism, and a hub is additionally provided and located on one side of the drum close to the second wire guide mechanism; outer winding strands drawn from the plurality of outer winding strand payoff spools sequentially pass the first wire guide mechanism, the pre-former, and the second wire guide mechanism, and are guided to the hub for gathering to complete strand wire twisting.

The multilayer strand steel wire rope production device provided in the present patent focuses on how an outer winding strand is twisted on a center strand so as to avoid outward protrusion and exposure of a central steel wire of the outer winding strand, and as for how to produce the outer winding strand and the center strand, the structure of the multilayer strand steel wire rope production device is basically the same as the common tubular-type stranding device in the market at present. Therefore, the difference between the present patent and the prior art is that: a pre-former is independently provided at the tail end of a drum in the existing tubular-type stranding device, that is, being located between the tail end of the drum and a hub, rather than being provided on the drum. By using the technical solution of the present patent, the position of the pre-former is adjusted to be close to the outer winding strand payoff spool. In the case of knowing a twisting pitch and a twisting angle of the multilayer strand steel wire rope, and a twisting pitch of the outer winding strand, and knowing that the position of the outer winding strand payoff spool is fixed with respect to the drum (that is, a distance, which is parallel to the axis of the drum, between the center of the outer winding strand payoff spool and the second wire guide mechanism is known) and the position of the hub is fixed with respect to the drum (that is, a distance between a point of tangency between the outer winding strand and the outer winding strand payoff spool and the first wire guide mechanism is known), the position of the pre-former is adjusted, that is, a proper distance, which is parallel to the axis of the drum, between the pre-former and the second wire guide mechanism is selected, so as to effectively avoid the phenomena of outward protrusion and core exposure of the central steel wire of the outer winding strand. In such a technology that the pre-former is provided on the drum, and the outer winding strand released by each outer winding strand payoff spool is pre-deformed by means of the pre-former, at present, no one has provided similar technical solutions in the art. Compared with the prior art, the technology in the present patent can fundamentally solve the phenomena of exposure and outward protrusion of the central steel wire of the outer winding strand after the multilayer strand steel wire rope is subjected to laying-up by using a tubular-type machine, and can ensure that this problem would not occur repeatedly (for example, after strand wires in a payoff base are used up, laying-up is performed by changing to another batch of strand wires or changing to strand wires having another twisting pitch specification), that is, continuous normal production of the multilayer strand steel wire rope is achieved, thereby greatly facilitating the actual production process.

Preferably, a calculation method of the position of the pre-former is:

S1. the twisting angle of the multilayer strand steel wire rope is $\alpha$, and when the drum rotates for a circle, the number of twisting circles of the outer winding strands on the drum is $(1-\cos\alpha)$ circles.

S2. the outer winding strands are released from the outer winding strand payoff spools till to the hub for finishing the twisting, the total number of circles for the drum to rotate is $N=(L_1+L_2+L_3)/T_1$; the number of twisting circles of the outer winding strands is $N'=N(1-\cos\alpha)$;

a theoretical exposure value of the central steel wire of the outer winding strand on a unit twisting pitch is $$\Delta L=T_2-(L_1+L_2+L_3)/[N'+(L_1+L_2+L_3)/T_2]$$

after a conversion, $$\Delta L=T_2-T_1T_2/[(1-\cos\alpha)T_2+T_1] \text{ is obtained;}$$

a distance, which is parallel to the axis of the drum, between the center of the first wire guide mechanism and the center of the second wire guide mechanism is $L_1$, a distance between a point of tangency between the outer winding strand and the outer winding strand payoff spool and the first wire guide mechanism is $L_2$, a distance between the center of the second wire guide mechanism and the hub is $L_3$, the twisting pitch of the multilayer strand steel wire rope is $T_1$, and the twisting pitch of the outer winding strand is $T_2$.

S3. a theoretical threshold of exposure of the central steel wire of the outer winding strand from the payoff spool to the pre-former is $L_0$, and when the exposure amount of the central steel wire of the outer winding strand reaches $L_0$, a theoretical length of the required outer winding strand is $L'=L_0T_2/\Delta L$.

S4. L is calculated according to a theoretical formula $L=L_1+L_2-L'$, L is a distance, which is parallel to the axis of the drum, between the pre-former and the center of the second wire guide mechanism, that is, the position of the pre-former.

A backward calculation method is specifically used for the position of the pre-former. A certain A point of the outer winding strand is used as a reference point, in the whole process of releasing A point from the outer winding strand payoff spool till to be finally twisted on the center strand, this section of outer winding strand is first preset, a theoretical threshold $L_0$ of outward protrusion of the central steel wire of the outer winding strand is determined, and when the drum rotates and is twisted, the exposing amount of the central steel wire of the outer winding strand in one outer winding strand twisting pitch $T_2$ is $\Delta L$. When one section of outer winding strand is continuously twisted on the surface of the center strand, the accumulated total exposing amount of the central steel wire of the outer winding strand is increased gradually, when the accumulated amount exceeds the theoretical threshold $L_0$, in the process of deforming by means of the pre-former, it is considered that the problem of outward protrusion occurs to the central steel wire of the outer winding strand. Therefore, when the outer winding strand is continuously twisted, the theoretical threshold $L_0$ is divided by $\Delta L$ to obtain the number of twisting pitches at which outward protrusion is just not determined, and then is multiplied by the twisting pitch $T_2$ of the outer winding strand, that is, to obtain the specific position of the pre-former when ensuring that outward protrusion of the central steel wire is just not determined for this section of outer winding strand. However, in the prior art, when the pre-former is conventionally provided at the hub, the length of the outer winding strand from the payoff base to the pre-former is basically equal to $L_1+L_2+L_3$, the exposing amount $(L_1+L_2+L_3)\Delta L/T_2$ of the central steel wire accumulated at the length would be far greater than the theoretical threshold set by us. Therefore, the phenomena of outward protrusion and exposure of the central steel wire would easily occur when passing the pre-former. The purpose of the calculation method is to calculate the position of the pre-former placed on the drum, parameters such as the theoretical threshold $L_0$ in the practical production process are determined according to a large number of experiments and practical experience, and are related to the diameter of the multilayer strand steel wire rope. However, the calculation methods and formulas provide a new idea for how to solve the problems of overturning and exposing of the central steel wire of the outer winding strand of the multilayer strand steel wire rope. Because the multilayer strand steel wire rope comprises multiple outer winding strands, multiple outer winding strand payoff spools exist and are arranged inside the drum in line. According to the positions of the outer winding strand payoff spools and the position of the hub, the position of the pre-former corresponding to the outer winding strand payoff spools can be determined by using the calculation formulas. Therefore, it is ensured that the problems of outward protrusion and core exposure would not occur after the central steel wire of each outer winding strand is twisted.

Preferably, the theoretical threshold of exposure of the central steel wire of the outer winding strand is $L_0 \leq 6.5$ D, and D is the diameter of the multilayer strand steel wire rope. By means of calculation of the applicant, when the value of the theoretical threshold does not exceed 6.5 D, the produced multilayer strand steel wire rope can just satisfy the quality requirements. When the value of the theoretical threshold is greater than 6.5 D, the problems of overturning and exposure of the central steel wire of the outer winding strand would easily occur.

Preferably, a stable tensile force provided by the outer winding strand payoff spool for the steel wire is 2-10% of a strand wire breaking force.

More preferably, the stable tensile force provided by the outer winding strand payoff spool for the steel wire is 6% of the strand wire breaking force.

Preferably, the pre-former is one of a needle-type deformer, a bearing deformer, a triangle deformer, a hexagon deformer, and a special-shaped deformer.

Compared with the prior art, the beneficial effects of the present invention are as follows:

1. The technical means that is not used by a person skilled in the art is used in the present application. The pre-former is fixed on the drum, and the specific position of the pre-former is defined, so that quality problems such as outward protrusion and core exposure occurred in the central steel wire of the outer winding strand can be better prevented;

2. the product quality of the multilayer strand steel wire rope is effectively improved, the product scrap rate is reduced, and the costs are greatly saved.

Figure 1:
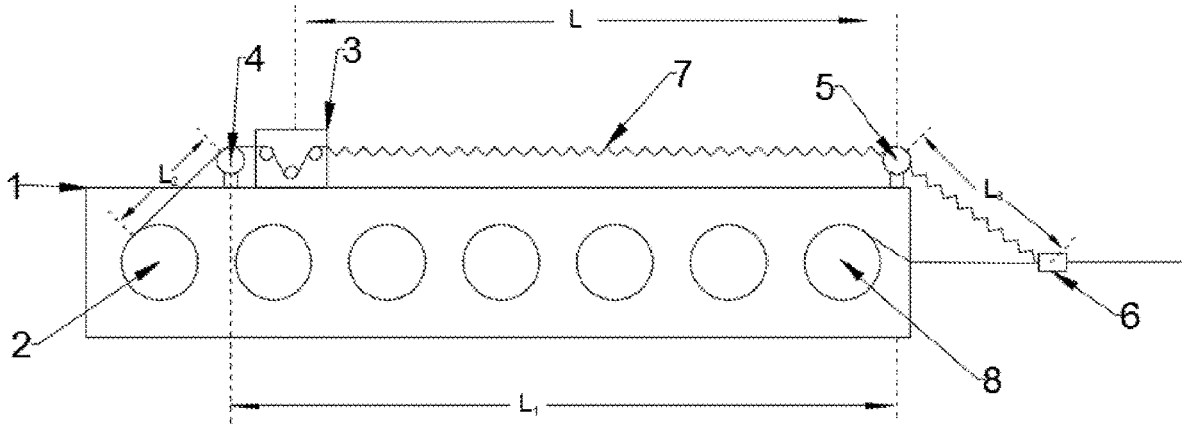
FIG. 1 is a schematic structural diagram when guide rollers are used as a first wire guide mechanism and a second wire guide mechanism in a multilayer strand steel wire rope production device in embodiment 1.

In the drawings: 1. a drum; 2. an outer winding strand payoff spool; 3. a pre-former; 4. a first wire guide mechanism; 5. a second wire guide mechanism; 6. a hub; 7. an outer winding strand; 8. a center strand payoff spool.

DETAILED DESCRIPTION

The technical solutions of the present invention are clearly and fully described below. Apparently, the described embodiments are merely some of the embodiments of the present invention, but not all the embodiments. Based on the embodiments of the present invention, all other embodiments obtained by a person of ordinary skill without involving an inventive effort shall fall within the scope of protection of the present invention.

Figure 2:
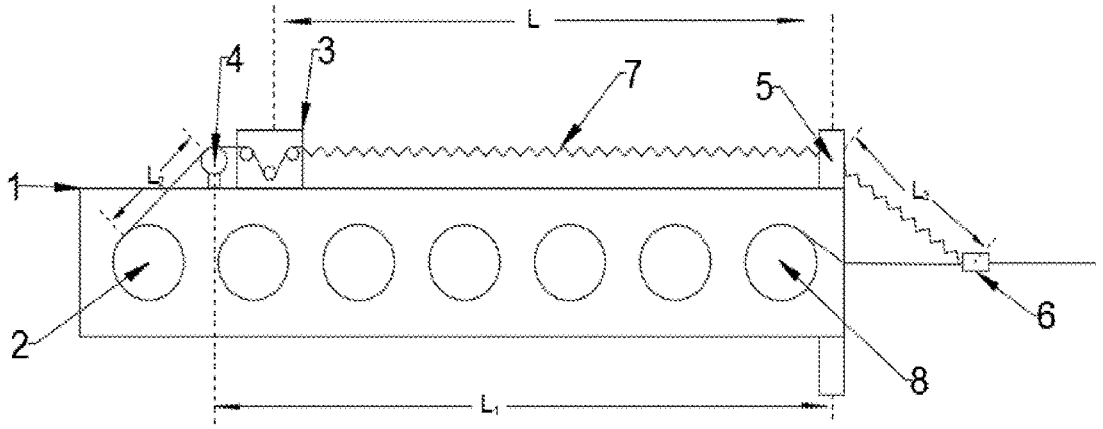
FIG. 2 is a schematic structural diagram when a guide roller is used as a first wire guide mechanism and a flywheel disc is used as a second wire guide mechanism in a multilayer strand steel wire rope production device in embodiment 1.
Figure 3:
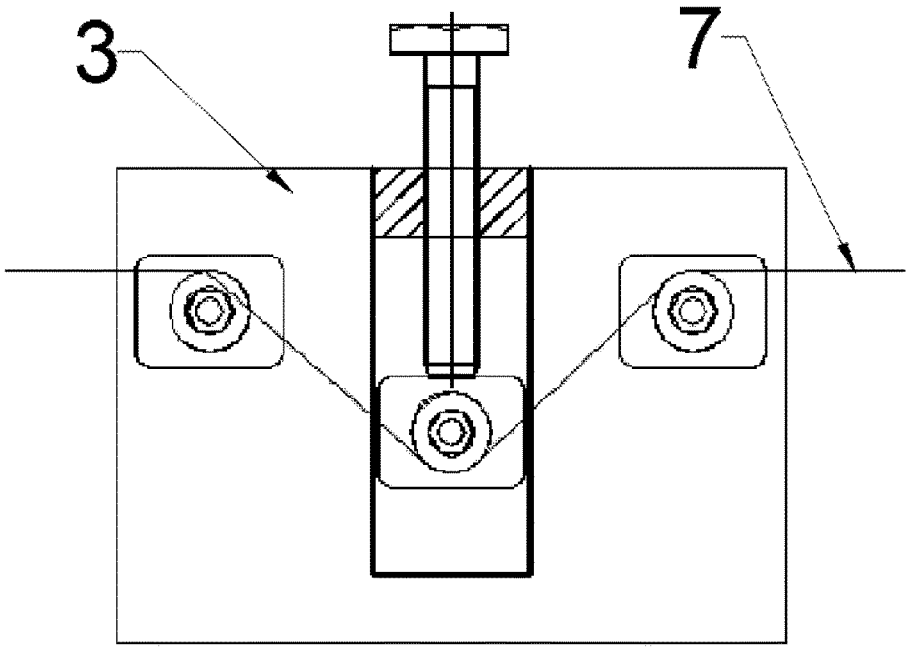
FIG. 3 is a schematic structural diagram of a pre-former of a multilayer strand steel wire rope production device in embodiment 1.
Figure 4:
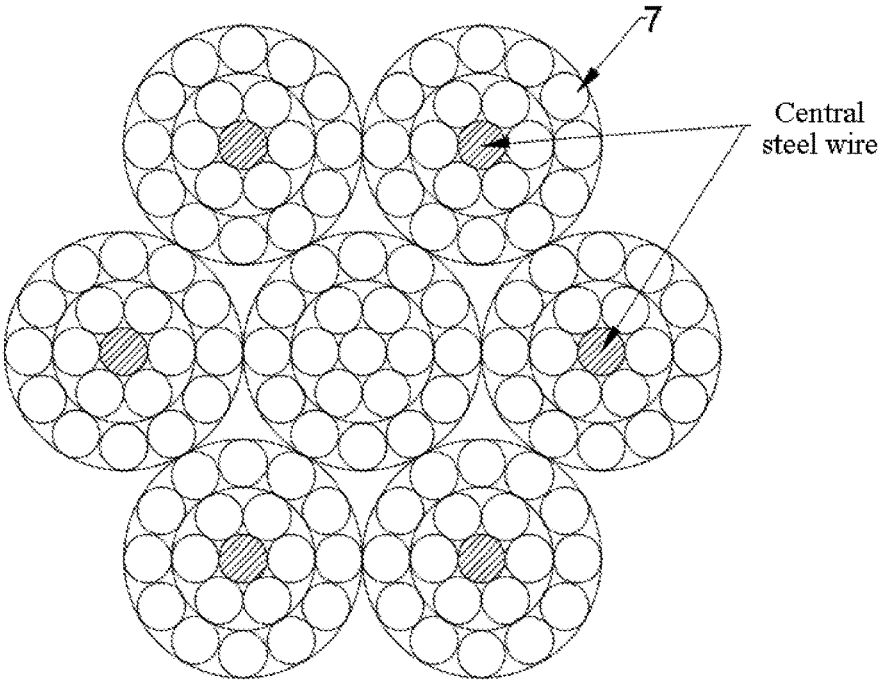
FIG. 4 is a schematic structural diagram of a cross section of a produced multilayer strand steel wire rope in embodiment 1.

As shown in FIG. 1 or FIG. 2, in the following embodiments, a plurality of outer winding strand payoff spools is provided inside a drum in line, a center strand payoff spool is closest to a hub, and when the drum rotates, the center strand payoff spool and the outer winding strand payoff spools would not rotate along with the drum. Therefore, when the pre-manufactured outer winding strand and center strand are further twisted to manufacture a multilayer strand steel wire rope, and when the drum rotates for one circle, an $L_2$ section of outer winding strand is to be twisted. Similarly, because of the limitation of stranding dies at the hub, an $L_3$ section of outer winding strand is also to be twisted. In the following embodiment, taking the production of an SZS alternating twisting structure of a 6*19-wsc structure of elevator door motor steel wire rope as an example, a twisting direction of the steel wire rope is an S twisting direction, a twisting direction of an outer winding strand is a Z twisting direction, and a twisting direction of a center strand is the S twisting direction, when the drum rotates, the $L_2$ section is twisted in a direction (i.e., the Z twisting direction) reverse to the twisting direction (the S twisting direction), and the $L_3$ section is twisted in the S twisting direction same as the twisting direction. Because the structure of the multilayer strand steel wire rope is alternating twisting, the outer winding strand has a twisting effect under the effect of the Z twisting direction at the $L_2$ section based on the original Z twisting direction, and has a detwisting effect under the effect of the S twisting direction at the $L_3$ section based on the original Z twisting direction. According to "STEEL TIRE CORD PRODUCTION" (Wang Tianchong and CHU Yuanzhang, STEEL TIRE CORD PRODUCTION [M], BEIJING: Press of University of Science and Technology Beijing, 1996: 145.), it can be known that a twisting angle generated at the $L_2$ section when the drum rotates for a circle is $2\pi$ (i.e., a circle), a twisting angle generated at the $L_3$ section is $2\pi\cos\alpha$ (i.e., cosa circle), and $\alpha$ is a twisting angle of the rope. Therefore, twisting of the outer winding strand at a unit length is $2\pi(1-\cos\alpha)$, i.e., $(1-\cos\alpha)$ circle. It can be known according to the contents disclosed above, when producing the alternating twisting steel wire rope, the twisting of the $L_2$ section of outer winding strand is same as the twisting direction of the outer winding strand. When twisting, the outer winding strand is released from the outer winding strand payoff spool and is always subjected to a twisting effect, the $L_3$ section of outer winding strand is detwisted, but is also twisted for $(1-\cos\alpha)$ circle actually. Because the central steel wire of the outer winding strand would not change in the twisting process, and an outer winding single steel wire of the outer winding strand is in a twisted state, the central steel wire of the outer winding strand has a tendency of outward protrusion and exposure.

In the following embodiment, the multilayer strand steel wire rope used therein is 6*19-wsc alternating twisting structure of steel wire rope having a steel wire rope diameter of 3.2 mm, the specific structure of the steel wire rope is (0.265+6*0.245+12*0.245)+6*(0.245+6*0.205+12*0.205), the twisting pitch of the steel wire rope is $T_1$=21.5 mm, and the twisting pitch of the outer winding strand is $T_2$=6.5 mm or 13.5 mm.

A distance, which is parallel to the axis of the drum, between the pre-former and the center of the second wire guide mechanism is L. A distance, which is parallel to the axis of the drum, between the center of the first wire guide mechanism and the center of the second wire guide mechanism is $L_1$. A distance between a point of tangency between the outer winding strand and the outer winding strand payoff spool and the first wire guide mechanism is $L_2$. A distance between the center of the second wire guide mechanism and the hub is $L_3$.

Embodiment 1

As shown in FIGS. 1-4, a structure similar to a Tyrone tubular-type stranding machine is used in a multilayer strand steel wire rope production device provided in this embodiment, where the production device includes a drum 1, six outer winding strand payoff spools 2 and one center strand payoff spool 8 are provided in the drum 1, pre-former 3 corresponding to the outer winding strand payoff spools 2 are provided on the outer surface of the drum 1, a first wire guide mechanism 4 tightly close to the pre-former 3 is provided on the outer surface of the drum 1, one end of the outer surface of the drum 1 away from the first wire guide mechanism 4 is provided with a second wire guide mechanism 5, and a hub 6 is additionally provided and located on one side of the drum 1 close to the second wire guide mechanism 5. Outer winding strands 7 drawn from the plurality of outer winding strand payoff spools 2 sequentially pass the first wire guide mechanism 4, the pre-former 3, and the second wire guide mechanism 5, and are guided to the hub 6 for gathering to complete strand wire twisting. The six outer winding strand payoff spools 2 are respectively named as number one to number six outer winding strand payoff spools according to a distance from the hub 6 from far to near, and corresponding pre-formers 3 are also named as number one to number six pre-formers. Six payoff spools are drawn in FIG. 1 or FIG. 2, and the position of number one pre-former is only drawn, the positions of other pre-formers are similar to that of number one pre-former, and therefore are not drawn. In the device provided in FIG. 1, the first wire guide mechanism and the second wire guide mechanism are common guide rollers in the art. In the device provided in FIG. 2, the first wire guide mechanism is the guide roller, the second wire guide mechanism is a common flywheel disc in the art, and a plurality of threading holes is provided on the flywheel disc and is used for passing and guiding of the outer winding strand.

For the position of the pre-former on the drum, that is, the calculation method of L is:

S1. the twisting angle of the multilayer strand steel wire rope is $\alpha=\arctan \pi[(0.265+4*0.245)+(0.245+4*0.205)]/21.5=18.64°$, and when the drum rotates for a circle, the number of twisting circles of the outer winding strands on the drum is $(1-\cos \alpha)$ circles.

S2. the outer winding strands are released from the outer winding strand payoff spools till to the hub for finishing the twisting, the total number of circles for the drum to rotate is $N=(L_1+L_2+L_3)/T_1$; the number of twisting circles of the outer winding strands is $N'=N(1-\cos \alpha)$;

a theoretical exposure value of a central steel wire of the outer winding strand on a unit twisting pitch is $$\Delta L=T_2-(L_1+L_2+L_3)/[N'+(L_1+L_2+L_3)/T_2];$$

after a conversion, $$\Delta L=T_2-T_1T_2/[(1-\cos \alpha)T_2+T_1] \text{ is obtained;}$$

a distance, which is parallel to the axis of the drum, between the pre-former and the center of the second wire guide mechanism is L; by means of measurement, a distance, which is parallel to the axis of the drum, between the center of number one outer winding strand payoff spool and the center of the second wire guide mechanism is $L_1$=6500 mm; a distance between a point of tangency between the outer winding strand and the outer winding strand payoff spool and the first wire guide mechanism is $L_2$=500 mm; a distance between the center of the second wire guide mechanism and the hub is $L_3$=500 mm; a twisting pitch of the multilayer strand steel wire rope is $T_1$=21.5 mm, and a twisting pitch of the outer winding strand is $T_2$=13.5 mm, so as to obtain $\Delta L$=0.43 mm by means of calculation.

S3. a theoretical threshold of exposure of the central steel wire of the outer winding strand is $L_0$=6.5 D=20.8 mm, and a theoretical length of the required outer winding strand is L'=653 mm by means of calculation.

S4. L=6347 mm is calculated according to the formula $L=L_1+L_2-L'$, that is, L=97.64% $L_1$.

Similarly to number one outer winding strand payoff spool, a distance, which is parallel to the axis of the drum, between the center of the first wire guide mechanism corresponding to number two outer winding strand payoff spool and the second wire guide mechanism is $L_1$=5500 mm, $\Delta L$=0.43 mm, and L=5347 mm of number two pre-former is calculated, that is, L=97.21% $L_1$.

By analogy, a distance, which is parallel to the axis of the drum, between the center of the first wire guide mechanism corresponding to number three outer winding strand payoff spool and the second wire guide mechanism is $L_1$=4500 mm, and L=4347 mm of number three pre-former is calculated, that is, L=96.6% $L_1$.

A distance, which is parallel to the axis of the drum, between the center of the first wire guide mechanism corresponding to number four outer winding strand payoff spool and the second wire guide mechanism is $L_1$=3500 mm, L=3347 mm of number four pre-former is calculated, that is, L=95.63% $L_1$.

A distance, which is parallel to the axis of the drum, between the center of the first wire guide mechanism corresponding to number five outer winding strand payoff spool and the second wire guide mechanism is $L_1$=2500 mm, L=2347 mm of number five pre-former is calculated, that is, L=93.88% $L_1$.

A distance, which is parallel to the axis of the drum, between the center of the first wire guide mechanism corresponding to number six outer winding strand payoff spool and the second wire guide mechanism is $L_1$=1500 mm, L=1347 mm of number six pre-former is calculated, that is, L=89.8% $L_1$.

The center strand payoff spool is used for releasing a center strand, and therefore, no pre-former is provided.

Embodiment 2

A multilayer strand steel wire rope production device same as that selected in embodiment 1 is selected in this embodiment, and the difference is that a twisting pitch of an outer winding strand selected in this embodiment is $T_2$=6.5 mm, and $\Delta L$=0.1 mm is calculated. When a theoretical threshold of exposure of a central steel wire of the outer winding strand is $L_0$=20.8 mm, L'=1352 mm is calculated.

Furthermore, a calculation method same as that in embodiment 1 is used, $L_1$=6500 mm, L=5648 mm of No.1 pre-former is calculated, that is, L=86.89% $L_1$.

Similarly to number one outer winding strand payoff spool, a distance, which is parallel to the axis of the drum, between the center of the first wire guide mechanism corresponding to number two outer winding strand payoff spool and the second wire guide mechanism is $L_1$=5500 mm, and L=4648 mm of number two pre-former is calculated, that is, L=84.51% $L_1$.

By analogy, a distance, which is parallel to the axis of the drum, between the center of the first wire guide mechanism corresponding to number three outer winding strand payoff spool and the second wire guide mechanism is $L_1$=4500 mm, and L=3648 mm of number three pre-former is calculated, that is, L=81.06% $L_1$.

A distance, which is parallel to the axis of the drum, between the center of the first wire guide mechanism corresponding to number four outer winding strand payoff spool and the second wire guide mechanism is $L_1$=3500 mm, L=2648 mm of number four pre-former is calculated, that is, L=75.65% $L_1$.

A distance, which is parallel to the axis of the drum, between the center of the first wire guide mechanism corresponding to number five outer winding strand payoff spool and the second wire guide mechanism is $L_1$=2500 mm, L=1648 mm of number five pre-former is calculated, that is, L=65.92% $L_1$.

A distance, which is parallel to the axis of the drum, between the center of the first wire guide mechanism corresponding to number six outer winding strand payoff spool and the second wire guide mechanism is $L_1$=1500 mm, L=648 mm of number six pre-former is calculated, that is, L=43.2% $L_1$.

The center strand payoff spool is used for releasing a center strand, and therefore, no pre-former is provided.

Embodiment 3

This comparative example is basically same as embodiment 1, and the difference is that a theoretical threshold of exposure of a central steel wire of the outer winding strand according to the comparative example is $L_0$=6.0 D.

A calculation method same as that in embodiment 1 is used to obtain:

L=6420 mm of number one pre-former, that is, L=98.77% $L_1$;

L=5420 mm of number two pre-former, that is, L=98.55% $L_1$;

L=4420 mm of number three pre-former, that is, L=98.22% $L_1$;

L=3420 mm of number four pre-former, that is, L=97.71% $L_1$;

L=2420 mm of number five pre-former, that is, L=96.8% $L_1$;

L=1420 mm of number six pre-former, that is, L=94.67% $L_1$.

COMPARATIVE EXAMPLE 1

This comparative example is basically same as embodiment 1, and the difference is that a theoretical threshold of exposure of a central steel wire of the outer winding strand according to the comparative example is $L_0$=7.0 D.

A calculation method same as that in embodiment 1 is used to obtain:

L=6297 mm of number one pre-former, that is, L=96.87% $L_1$;

L=5297 mm of number two pre-former, that is, L=96.31% $L_1$;

L=4297 mm of number three pre-former, that is, L=95.49% $L_1$;

L=3297 mm of number four pre-former, that is, L=94.2% $L_1$;

L=2297 mm of number five pre-former, that is, L=91.88% $L_1$;

L=1297 mm of number six pre-former, that is, L=86.47% $L_1$.

COMPARATIVE EXAMPLE 2

Figure 5:
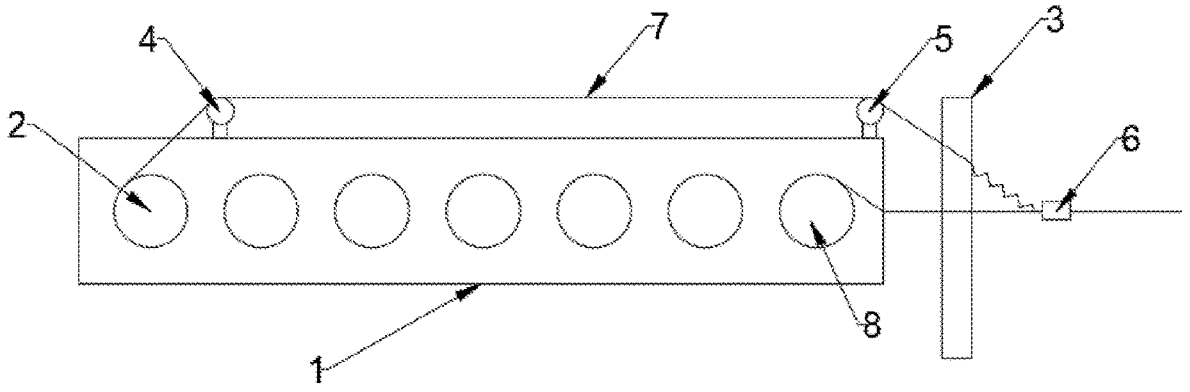
FIG. 5 is a schematic structural diagram of a multilayer strand steel wire rope production device (a pre-former is placed at a conventional position) in comparative example 3.

As shown in FIG. 5, a general Tyrone tubular-type stranding machine is used in this comparative example, a pre-former is provided between a drum and a hub, all the outer winding strands in the drum are pre-deformed by means of the pre-former and then are twisted at the hub.

Application example 1: detection of quality of multilayer strand steel wire ropes produced in multilayer strand steel wire rope production devices according to embodiments 1-3 and comparative examples 1 and 2.

According to YBT 4251, the surfaces of steel wires shall be smooth and flat, and defects such as interleaving, bending and broken wires shall not exist in the steel wires in a steel wire rope. Problems of overturinng and exposure of central steel wires of outer winding strands of the multilayer strand steel wire ropes produced in the multilayer strand steel wire rope production devices according to embodiments 1-3 and comparative examples 1 and 2 are detected. Specific results are shown in Table 1 below.

TABLE 1 detection results of multilayer strand steel wire ropes in embodiments 1-3 and comparative examples 1 and 2

| Number | Embodiment 1 | Embodiment 2 | Embodiment 3 | Comparative example 1 | Comparative example 2 |
|---|---|---|---|---|---|
| Detection results | Flat surface Feel smooth | Flat surface Feel smooth | Flat surface Feel smooth | The surface of the rope has steel wire bending, and is sharp and thorny | The surface of the rope has steel wire bending, and is sharp and thorny |
| Determination results | Qualified | Qualified | Qualified | Unqualified | Unqualified |

According to the detection results above, it can be known that the technical solution provided in the present patent is used, compared with the existing tubular-type stranding machine, outward protrusion and exposure of the central steel wires of the outer winding strands can be better prevented actually, and it is indicated that the calculation method about the position of the pre-former in the present application is relatively scientific and reasonable, and in line with the actual situation. Moreover, when a theoretical threshold of exposure of the central steel wire of the outer winding strand is $L_0$=6.0 D and 6.5 D, the quality of the manufactured multilayer strand steel wire rope is high. However, the theoretical threshold is slightly increased to 7 D, a few quality problems would occur. This indicates that it is relatively accurate and reasonable that the value of the theoretical threshold $L_0$ does not exceed 6.5 D.

What is claimed is:

1. A multilayer strand steel wire rope production device, comprising a drum, wherein, a center strand payoff spool and a plurality of outer winding strand payoff spools are provided in the drum, a plurality of pre-formers and a plurality of first wire guide mechanisms, which are respectively corresponding to the outer winding strand payoff spools, are provided on an outer surface of main body of the drum, and each of the first wire guide mechanisms is close to the respectively corresponding outer winding strand payoff spool;

one end of the outer surface of the drum away from the first wire guide mechanisms is provided with a plurality of second wire guide mechanisms, and a hub is additionally provided and located on one side of the drum close to the second wire guide mechanisms;

each of outer winding strands drawn from the plurality of outer winding, strand payoff spools sequentially passes the respectively corresponding first wire guide mechanism, the respectively corresponding pre-former, and the respectively corresponding second wire guide mechanism, and the outer winding strands are guided to the hub for gathering to complete strand wire twisting.

2. The multilayer strand steel wire rope production device according to claim 1, wherein, the position of each pre-former on the drum is calculated as follows:

with regard to one pre-former of the plurality of pre-formers, and the outer winding strand, the outer winding strand payoff spool, the first wire guide mechanism and the second wire guide mechanism corresponding to the one pro-former, S1. when the drum rotates for a circle, a number of twisting circles of the outer winding strands on the drum is $(1-\cos\alpha)$ circles; where $\alpha$ is a calculated twisting angle value of the multilayer strand steel wire rope;

S2. the outer winding strands are released from the outer winding strand payoff spools till to the hub for finishing the twisting, a total number of circles for the drum to rotate is $N=(L_1+L_2+L_3)/T_1$; a number of twisting circles of the outer winding strands is $N'=N(1-\cos\alpha)$;

a theoretical exposure value of a central steel wire of the outer winding strand on a unit twisting pitch is $$\Delta L=T_2-(L_1+L_2+L_3)/[N'+(L_1+L_2+L_3)/T_2];$$

after a conversion, $$\Delta L=T_2-T_1T_2/[(1-\cos\alpha)T_2+T_1] \text{ is obtained;}$$

a distance, which is parallel to an axis of the drum, between a center of the first wire guide mechanism and a center of the second wire guide mechanism is $L_1$, a distance from a point of tangency between the outer winding strand and the outer winding strand payoff spool to the first wire guide mechanism is $L_2$, a distance between a center of the second wire guide mechanism and the hub is $L_3$, a twisting pitch of the multilayer strand steel wire rope is $T_1$, and a twisting pitch of the outer winding strand is $T_2$;

S3. a theoretical threshold of exposure of the central steel wire of the outer winding strand from the payoff spool to the pre-former is $L_0$, and when an exposure amount of the central steel wire of the outer winding strand reaches $L_0$, a theoretical length of the required outer winding strand is $L'=L_0T_2/\Delta L$;

S4. L is calculated according to a theoretical formula $L=L_1+L_2-L'$, L is a distance, which is parallel to the axis of the drum, between the pre-former and the center of the second wire guide mechanism, that is, the position of the pre-former.

3. The multilayer strand steel wire rope production device according to claim 2, wherein, a theoretical threshold of exposure of the central steel wire of the outer winding strand is $L_0 \leq 6.5$ D, and D is a diameter of the multilayer strand steel wire rope.

4. The multilayer strand steel wire rope production device according to claim 3, wherein, a stable tensile force provided by the outer winding strand payoff spool for the steel wire is 2-10% of a strand wire breaking force.

5. The multilayer strand steel wire rope production device according to claim 4, wherein, the stable tensile force provided by the outer winding strand payoff spool for the steel wire is 6% of the strand wire breaking force.

6. The multilayer strand steel wire rope production device according to claim 1, wherein, each of the pre-formers is a needle-type deformer, a triangle deformer, or a hexagon deformer.

7. The multilayer strand steel wire rope production device according to claim 2, wherein, a stable tensile force provided by the outer winding strand payoff spool for the steel wire is 2-10% of a strand wire breaking force.

8. The multilayer strand steel wire rope production device according to claim 3, wherein, a stable tensile force provided by the outer winding strand payoff spool for the steel wire is 2-10% of a strand wire breaking force.

* * * * *